US012290226B2

(12) United States Patent
Thiyagarajan

(10) Patent No.: US 12,290,226 B2
(45) Date of Patent: May 6, 2025

(54) DISHWASHING APPLIANCE HAVING AN AIR-DRYING DEHUMIDIFICATION ASSEMBLY

(71) Applicant: Haier US Appliance Solutions, Inc., Wilmington, DE (US)

(72) Inventor: Ramasamy Thiyagarajan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 496 days.

(21) Appl. No.: 17/729,125

(22) Filed: Apr. 26, 2022

(65) Prior Publication Data

US 2023/0337892 A1 Oct. 26, 2023

(51) Int. Cl.
*A47L 15/42* (2006.01)
*A47L 15/48* (2006.01)

(52) U.S. Cl.
CPC ..... *A47L 15/483* (2013.01); *A47L 15/4225* (2013.01); *A47L 15/4287* (2013.01); *A47L 15/486* (2013.01); *A47L 2401/12* (2013.01); *A47L 2401/18* (2013.01); *A47L 2401/19* (2013.01); *A47L 2501/05* (2013.01); *A47L 2501/12* (2013.01)

(58) Field of Classification Search
None
See application file for complete search history.

(56) References Cited

U.S. PATENT DOCUMENTS

| | | | |
|---|---|---|---|
| 9,574,804 | B2 | 2/2017 | Dreossi et al. |
| 10,849,481 | B2 | 12/2020 | Hofmann et al. |
| 10,986,977 | B2 | 4/2021 | Vallejo et al. |
| 2003/0140517 | A1 | 7/2003 | Schmid |
| 2004/0261820 | A1 | 12/2004 | Monsrud et al. |
| 2017/0055804 | A1 | 3/2017 | Hockaday et al. |
| 2020/0345203 | A1* | 11/2020 | Vallejo ..... B01D 5/0081 |

FOREIGN PATENT DOCUMENTS

| | | | |
|---|---|---|---|
| CN | 111345761 | A | 6/2020 |
| EP | 1838204 | B1 | 3/2012 |

* cited by examiner

*Primary Examiner* — Levon J Shahinian
(74) *Attorney, Agent, or Firm* — Dority & Manning, P.A.

(57) ABSTRACT

A dishwashing appliance may include a cabinet, a tub, a pump, a spray assembly, a fluid recirculation duct, a cold water loop, a heat exchanger, and a tub fan. The fluid recirculation duct may extend from a path inlet to a path outlet to recirculate air within a wash chamber. The cold water loop may define a cold water nozzle disposed within the fluid recirculation duct to provide a condensing, cold-water flow into the fluid recirculation duct between the path inlet and the path outlet. The heat exchanger may be mounted to the cold water loop outside of the fluid recirculation duct to cool water within the cold water loop. The tub fan may be configured to selectively motivate an airflow from the path inlet to the path outlet.

15 Claims, 5 Drawing Sheets

DISHWASHING APPLIANCE HAVING AN AIR-DRYING DEHUMIDIFICATION ASSEMBLY

FIELD OF THE INVENTION

The present subject matter relates generally to washer appliances, and more particularly to dishwashing appliances having an assembly for circulating drying air therein.

BACKGROUND OF THE INVENTION

Dishwashing appliances generally include a tub that defines a wash chamber for receipt of articles for washing. Certain dishwasher assemblies also include a rack assembly slidably mounted within the wash chamber. A user can load articles, such as plates, bowls, glasses, or cups, into the rack assembly, and the rack assembly can support such articles within the wash chamber during operation of the dishwashing appliance. Spray assemblies within the wash chamber can apply or direct wash fluid towards articles disposed within the rack assemblies in order to clean such articles. Multiple spray assemblies can be provided, including, for example, a lower spray arm assembly mounted to the tub at a bottom of the wash chamber; a mid-level spray arm assembly mounted to one of the rack assemblies; or an upper spray assembly mounted to the tub at a top of the wash chamber. Other configurations may be used as well.

After the spray assemblies have washed or sprayed articles on the rack assemblies, typical dishwashing appliances provide one or more features to circulate air and remove moisture from (i.e., dry) the articles. Commonly, such features are provided as part of a closed loop or an open loop system. Closed loop systems often draw air from the wash chamber through a small inlet in one corner of the door before returning that same air to the wash chamber (e.g., after being heated or dried). Open loop systems generally motivate air from the ambient environment to the wash chamber, such as through a small vent within the door.

These existing systems present a number of drawbacks. For instance, existing appliances often have difficulty managing the moisture or humidity within the air being circulated. In existing appliances with a closed loop system, an appliance may have difficulty removing moisture from air or may have a limited absorption capacity. In existing appliances with an open loop system, performance may be uneven or undesirably influenced by humidity in the ambient air. Moreover, any energy used to heat air within the wash chamber is generally lost to the ambient environment.

There is, thus, a need for an improved dishwashing appliance. In particular, it would be advantageous to provide a dishwashing appliance with one or more features to efficiently dry air within the wash chamber.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwashing appliance is provided. The dishwashing appliance may include a cabinet, a tub, a pump, a spray assembly, a fluid recirculation duct, a cold water loop, a heat exchanger, and a variable-speed tub fan. The tub may be housed within the cabinet and defining a wash chamber. The pump may be configured to deliver a wash fluid to the wash chamber. The spray assembly may be housed within the wash chamber of the tub in fluid communication with the pump to receive wash fluid therefrom. The fluid recirculation duct may extend from a path inlet to a path outlet to recirculate air within the wash chamber. The path inlet may be defined in fluid communication between the wash chamber and the path outlet. The path outlet may be defined in fluid communication between the path inlet and the wash chamber downstream from the path inlet. The cold water loop may define a cold water nozzle disposed within the fluid recirculation duct to provide a condensing, cold-water flow into the fluid recirculation duct between the path inlet and the path outlet. The heat exchanger may be mounted to the cold water loop outside of the fluid recirculation duct to cool water within the cold water loop. The variable-speed tub fan may be configured to rotate at a plurality of discrete speeds. The variable-speed tub fan may be in fluid communication with the fluid recirculation duct to selectively motivate a variable airflow from the path inlet to the path outlet.

In another exemplary aspect of the present disclosure, a dishwashing appliance is provided. The dishwashing appliance may include a cabinet, a tub, a pump, a spray assembly, a fluid recirculation duct, a cold water loop, a heat exchanger, and a tub fan. The tub may be housed within the cabinet and defining a wash chamber. The pump may be configured to deliver a wash fluid to the wash chamber. The spray assembly may be housed within the wash chamber of the tub in fluid communication with the pump to receive wash fluid therefrom. The fluid recirculation duct may extend from a path inlet to a path outlet to recirculate air within the wash chamber. The path inlet may be defined in fluid communication between the wash chamber and the path outlet. The path outlet may be defined in fluid communication between the path inlet and the wash chamber downstream from the path inlet. The cold water loop may define a cold water nozzle disposed within the fluid recirculation duct to provide a condensing, cold-water flow into the fluid recirculation duct between the path inlet and the path outlet. The heat exchanger may be mounted to the cold water loop outside of the fluid recirculation duct to cool water within the cold water loop. The tub fan may be configured to selectively motivate an airflow from the path inlet to the path outlet. The tub fan may be mounted downstream from the path inlet in upstream fluid communication with the wash chamber.

In yet another exemplary aspect of the present disclosure, a dishwashing appliance is provided. The dishwashing appliance may include a cabinet, a tub, a pump, a spray assembly, a fluid recirculation duct, a cold water loop, a loop pump, a heat exchanger, a loop fan, and a variable-speed tub fan. The tub may be housed within the cabinet and defining a wash chamber. The pump may be configured to deliver a wash fluid to the wash chamber. The spray assembly may be housed within the wash chamber of the tub in fluid communication with the pump to receive wash fluid therefrom. The fluid recirculation duct may extend from a path inlet to a path outlet to recirculate air within the wash chamber. The path inlet may be defined in fluid communication between the wash chamber and the path outlet. The path outlet may be defined in fluid communication between the path inlet and the wash chamber downstream from the path inlet. The cold water loop may define a cold water nozzle disposed within the fluid recirculation duct to provide a condensing, cold-water flow into the fluid recirculation duct between the path inlet and the path outlet. The loop pump may be mounted along the cold water loop to motivate the water within the cold water loop. The heat exchanger may be mounted to the cold water loop outside of the fluid recirculation duct to cool water within the cold water loop. The loop fan may be directed at the heat exchanger outside of the cold water loop to motivate an exchange airflow across the heat exchanger. The variable-speed tub fan may be configured to rotate at a plurality of discrete speeds. The variable-speed tub fan may be in fluid communication with the fluid recirculation duct to selectively motivate a variable airflow from the path inlet to the path outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
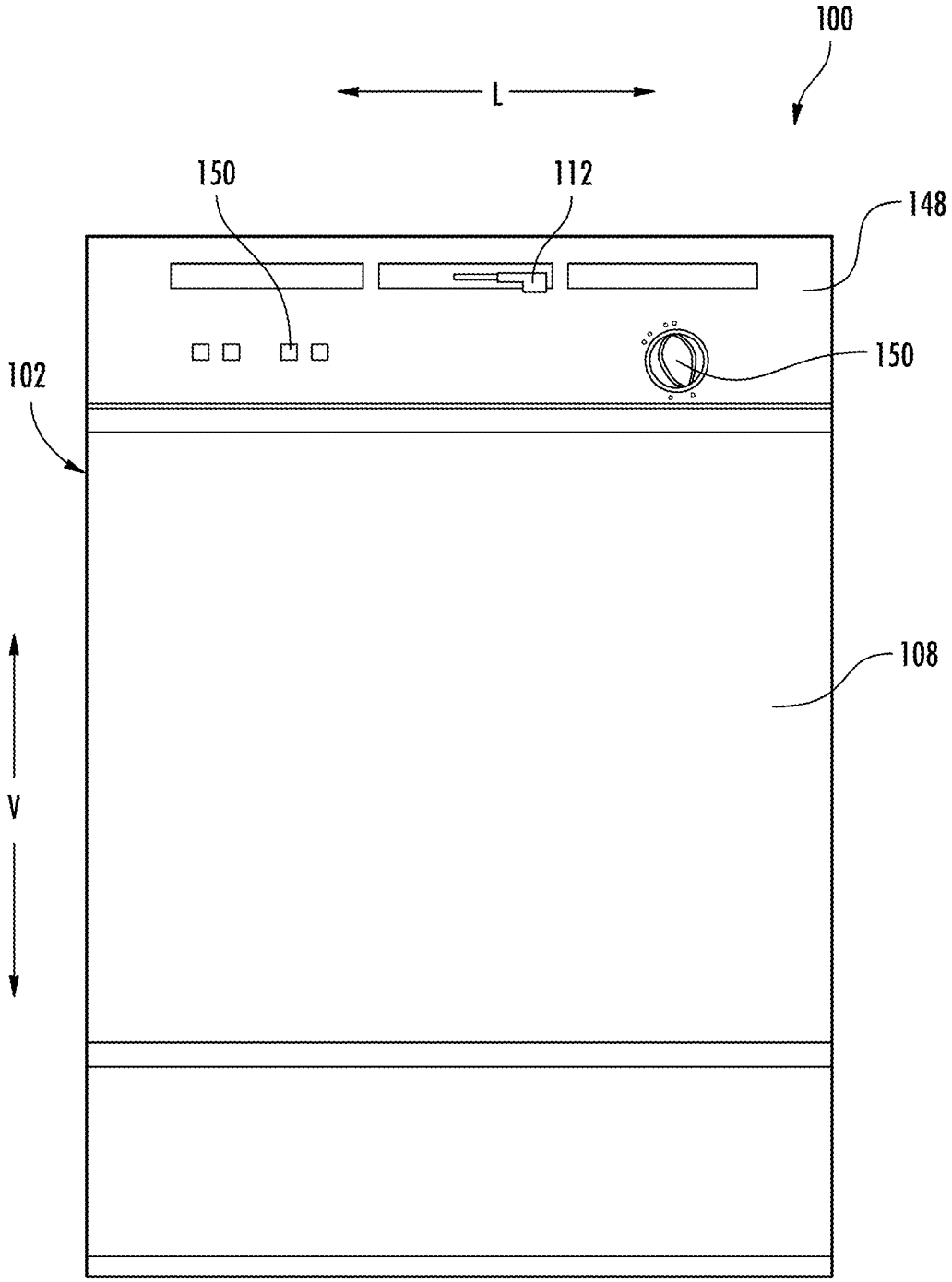
FIG. 1 provides a front elevation view of a dishwashing appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
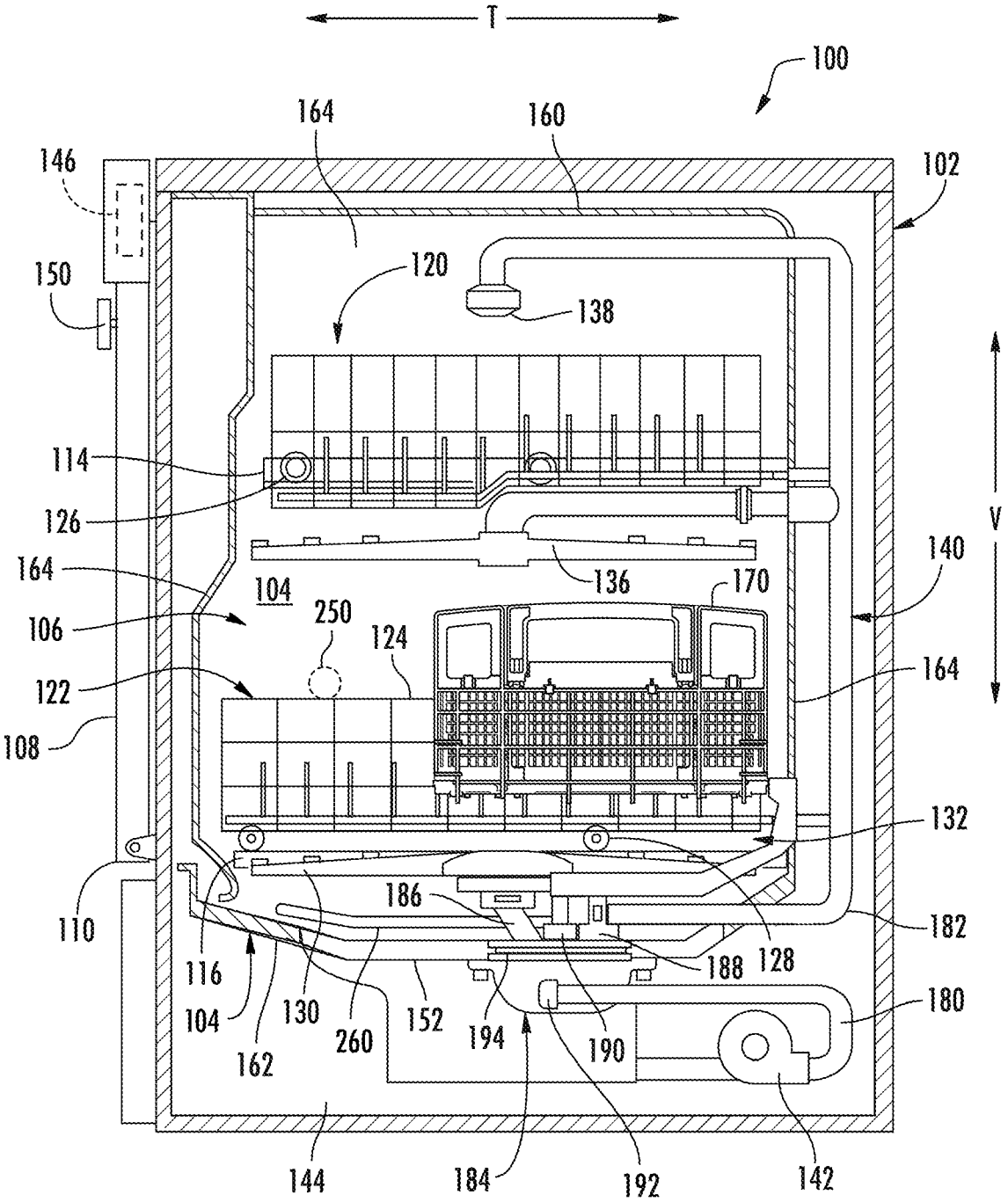
FIG. 2 provides a side, sectional view of the exemplary dishwashing appliance of FIG. 1.

Turning now to the figures, FIGS. 1 and 2 illustrate a domestic dishwashing appliance 100 according to exemplary embodiments of the present disclosure. As shown in FIGS. 1 and 2, the dishwashing appliance 100 may include a cabinet 102 having a tub 104 therein defining a wash chamber 106. The tub 104 may generally include a front opening and a door 108 hinged at its bottom 110 for rotatable movement between a closed or vertical position (shown in FIGS. 1 and 2), wherein wash chamber 106 is sealed shut for washing operation and access to wash chamber 106 is restricted, and a horizontal open position for loading and unloading of articles from the dishwashing appliance 100. As shown in FIG. 1, a latch 112 may be used to lock and unlock the door 108 for access to the chamber 106.

Generally, cabinet 102 may define a discrete vertical direction V, lateral direction L, and transverse direction T. Vertical direction V, lateral direction L, and transverse direction T are mutually perpendicular such that vertical direction V, lateral direction L, and transverse direction T form an orthogonal directional system. Cabinet 102 is generally configured for containing or supporting various components of appliance 100 and which may also define one or more internal chambers or compartments of appliance 100. In this regard, as used herein, the terms "cabinet," "housing," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof.) It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. However, in optional embodiments, the tub 104 may be formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside wash chamber 106, and a retracted position (shown in FIGS. 1 and 2) in which the rack 120, 122 is located inside wash chamber 106. This may be facilitated by rollers 126 and 128, for example, mounted onto racks 120 and 122, respectively.

In some embodiments, a silverware basket 170 is removably mounted to lower rack assembly 122. However, in alternative exemplary embodiments, the silverware basket 170 may also be selectively attached to other portions of dishwashing appliance 100 (e.g., door 108) or absent therefrom. The silverware basket 170 defines one or more storage chambers and is generally configured to receive of silverware, flatware, utensils, and the like, that are too small to be accommodated by the upper and lower rack assemblies 120, 122. The silverware basket 170 may be constructed of any suitable material (e.g., metal or plastic) and define a plurality of fluid slots for permitting wash fluid therethrough.

The dishwashing appliance 100 includes one or more spray assemblies housed within wash chamber 106. For instance, the dishwashing appliance 100 may include a lower spray-arm assembly 130 that is rotatably mounted within a lower region 132 of wash chamber 106 directly above the bottom wall 162 of the tub 104 so as to rotate in relatively close proximity to the rack assembly 122. As shown in FIG. 2, a mid-level spray-arm assembly 136 may be located in an upper region of wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a spray (e.g., a spray of washing fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within wash chamber 106.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In some such embodiments, input/output ("I/O") signals are routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

In some embodiments, an air sensor 250 is mounted within wash chamber 106 (e.g., to tub 104) in communication (e.g., electric or wireless communication) with controller 146 to transmit one or more signals thereto. In particular, air sensor 250 may be configured detect a condition of the air or environment within wash chamber 106 and transmit one or more signals corresponding to the controller 146 based on or corresponding to the detected condition. Such conditions may include temperature or humidity within the wash chamber 106 (e.g., during a washing operation or dry cycle in which a heater, such as heater 260 or 261 is active to heat air and articles within wash chamber 106). In some embodiments, the air sensor 250 includes or is provided as a temperature sensor (e.g., thermistor, thermocouple, etc.) configured to detect air temperature (e.g., as an air temperature value), which may in turn be transmitted to the controller 146. In additional or alternative embodiments, the air sensor 250 includes or is provided as a humidity sensor (e.g., capacitive hygrometer, resistive hygrometer, thermal hygrometer, optical hygrometer, etc.) configured to detect water vapor or air humidity (e.g., as an air humidity value), which may in turn be transmitted to the controller 146.

Generally, air sensor 250 may be disposed at any suitable location within wash chamber 106. In some embodiments, air sensor 250 is located below one or more spray assemblies 130, 136, 138. In additional or alternative embodiments, air sensor 250 is located below one or both of rack assemblies 120, 122 (e.g., upper rack 120). Moreover, as shown, air sensor 250 may be mounted at the bottom half or third of top. In other words, air sensor 250 may be provided at a height below a halfway or two-thirds point of a total height of wash chamber 106 (e.g., from bottom wall 162 to top wall 160) along the vertical direction V.

In additional or alternative embodiments, a water sensor 252 is mounted within cabinet (e.g., within or along a water path 212 of a cold water loop 230) in communication (e.g., electric or wireless communication) with controller 146 to transmit one or more signals thereto. In particular, water sensor 252 may be configured detect a condition of the water path 212 and transmit one or more signals corresponding to the controller 146 based on or corresponding to the detected condition. Such conditions may include water temperature (e.g., during a washing operation or dry cycle in which a heater, such as heater 260 or 261 is active to heat air and articles within wash chamber 106). In some embodiments, the water sensor 252 includes or is provided as a temperature sensor (e.g., thermistor, thermocouple, etc.) configured to detect water temperature (e.g., as a water temperature value), which may in turn be transmitted to the controller 146.

Additionally or alternatively, as shown in FIG. 2, a portion of the bottom wall 162 of the tub 104 may be configured as a tub 104 sump portion 152 that is configured to accommodate one or more components of the fluid recirculation assembly 140 (e.g., a filter assembly or other components). It should be appreciated that, in several embodiments, the bottom wall 162 of the tub 104 may be formed as a single, unitary component such that the tub 104 sump portion 152 as well as the surrounding portions of the bottom wall 162 are formed integrally with one another. Alternatively, the tub 104 sump portion 152 may be configured as a separate component configured to be attached to the remaining portion(s) of the bottom wall 162.

Optionally, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Additionally, the diverter assembly 184 may also include a diverter valve 194 to selectively divert the flow of fluid through the assembly 184 to the first outlet 186, the second outlet 188, or the third outlet 190.

In additional or alternative embodiments, a heater 260 (e.g., electric heating element) is mounted within wash chamber 106. Generally, heater 260 may include or be provided as any suitable air heating element, such as a resistive heat element, radiant heat element, etc. When assembled, heater 260 may be positioned on or above a bottom wall of tub 104. Moreover, heater 260 may be in operative (e.g., electrical or wireless) communication with controller 146. Controller 146 may thus selectively activate heater 260 to operate or otherwise generate heat within wash chamber 106.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Figure 3:
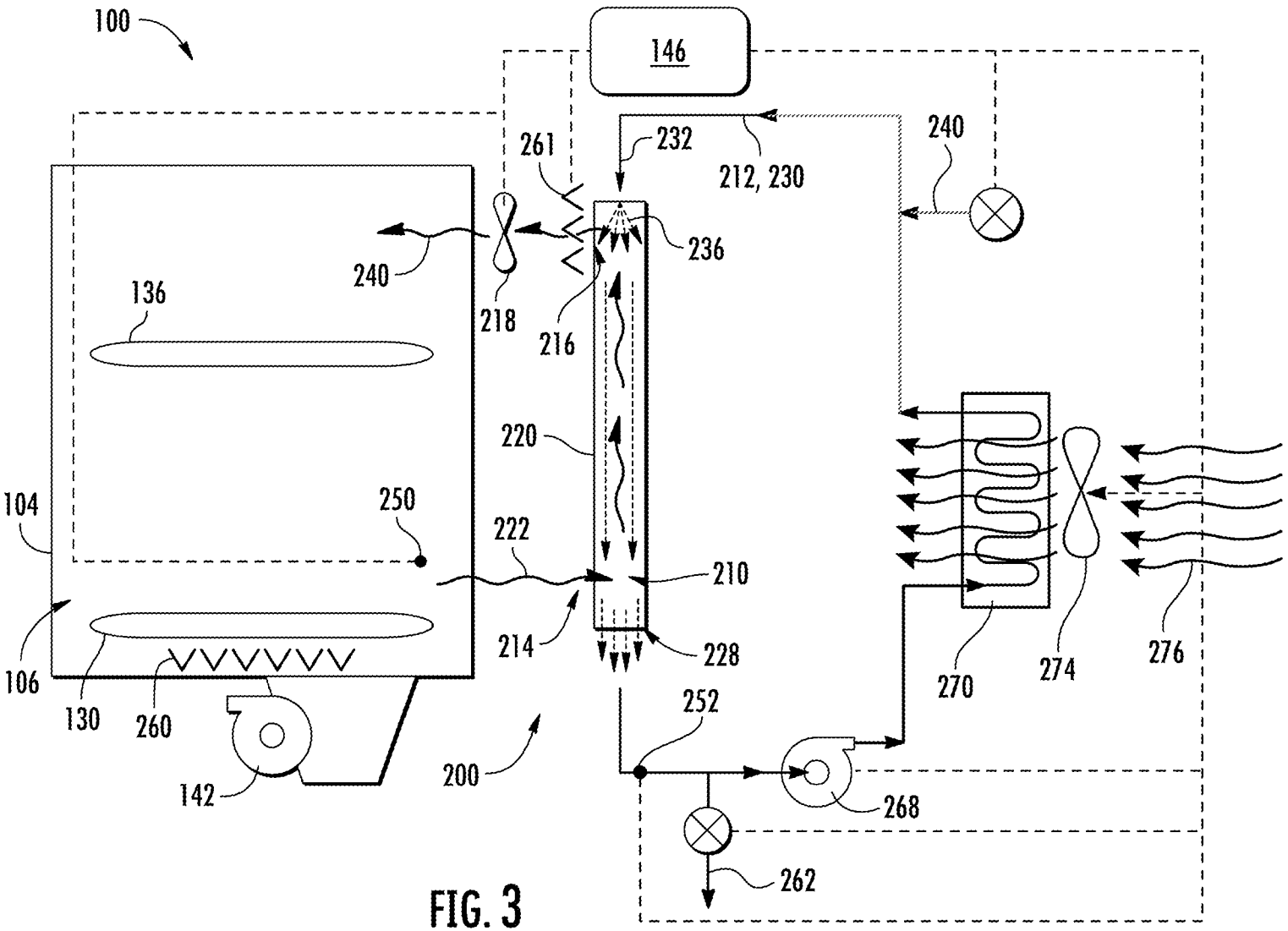
FIG. 3 provides a schematic view of a dishwashing appliance according to exemplary embodiments of the present disclosure.
Figure 4:
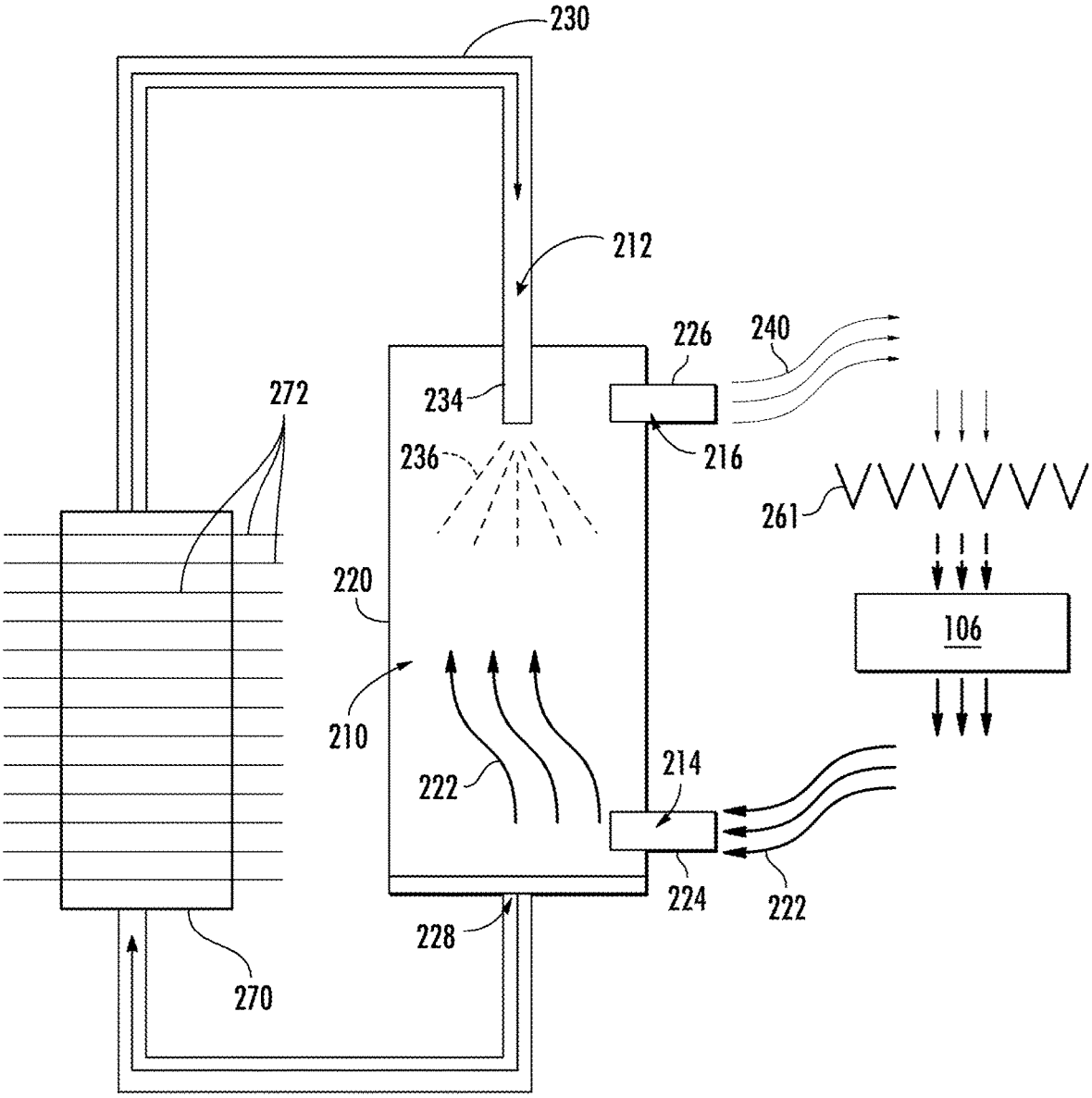
FIG. 4 provides another schematic view of a dishwashing appliance according to exemplary embodiments of the present disclosure.

Turning now to FIGS. 2 through 4, various views are provided that illustrate a dehumidification assembly 200 included with dishwashing appliance 100 according to exemplary embodiments of the present disclosure. Specifically, FIG. 3 provides separate schematic views of dehumidification assembly 200 in relation to wash chamber 106.

As shown, multiple discrete fluid paths 210, 212 are provided to selectively circulate air or vapor through dishwashing appliance 100 (e.g., as part of a drying or dry cycle). In particular, a discrete air path 210 and water path 212 may be provided. As will be described in greater detail below, during use, air path 210 (e.g., defined by fluid recirculation duct 220) may generally permit the recirculation of air through wash chamber 106 while water path 212 (e.g., defined by cold water loop 230) may recirculate apart from the tub 104 and permit the addition of a condensing, cold-water flow 232 to air path 210 (e.g., to a circulating airflow 222). During use, the condensing, cold-water flow 232 may advantageously prompt vaporized moisture within air path 210 (e.g., from wash chamber 106) to rapidly condense and separate from air before such air is returned to wash chamber 106.

A fluid recirculation duct 220 may define air path 210. For instance, fluid recirculation duct 220 extends from a path inlet 214 to a path outlet 216. Path inlet 214 may be defined (e.g., at an intake port 224) in fluid communication between wash chamber 106 and path outlet 216. Path outlet 216 may be defined (e.g., at an output port 226) downstream from path inlet 214 in fluid communication between path inlet 214 and wash chamber 106. For instance, path outlet 216 may be defined above path inlet 214. During use, air or vapor may exit wash chamber 106 and enter air path 210 through path inlet 214. From path inlet 214, at least a portion of the received air or vapor may flow through air path 210 before returning to wash chamber 106 through path outlet 216.

Generally, fluid recirculation duct 220 may be provided at any suitable location on or within cabinet 102. For instance, fluid recirculation duct may be mounted to one of the sidewalls 164. In turn, intake port 224 may be held on or extend through one wall while output port is held on or extends through the same or, alternatively, a different wall between top wall and bottom wall 162. Thus, fluid recirculation duct may direct air out of and around at least a portion of wash chamber 106 before returning it to wash chamber 106 at another location relative to tub 104.

As shown, a tub fan or blower 218 may be provided to motivate air or vapor from path inlet 214 to path outlet 216. Generally, tub fan 218 may include or be provided as any suitable air handler, such as an axial fan, tangential fan, etc. In some embodiments, tub fan 218 is mounted along air path 210 (e.g., within fluid recirculation duct 220). Tub fan 218 may be positioned between the path inlet 214 and path outlet 216 (i.e., downstream from path inlet 214 or upstream from path outlet 216). Additionally or alternatively, tub fan 218 may be mounted downstream from the path inlet in upstream fluid communication with the wash chamber 106. Further additionally or alternatively, tub fan 218 may be mounted in fluid communication between the nozzle 234 and path outlet 216 (i.e., downstream from the nozzle 234 and upstream from the path outlet 216 along path 210).

When assembled, tub fan 218 may be in operative (e.g., electrical or wireless) communication with controller 146. Controller 146 may thus selectively direct tub fan 218 to rotate or otherwise motivate air through air path 210. In some embodiments, tub fan 218 is provided as a variable-speed fan and is thus configured to vary the speed of its rotation (i.e., the rotation of a blade or impeller of tub fan 218). For instance, tub fan 218 may be configured to rotate at a plurality of discrete speeds. As would be understood, varying the speed of rotation of tub fan 218 may in turn vary the airspeed (e.g., the volumetric flow rate of air) of a variable airflow 222 through air path 210. In some such embodiments, tub fan 218 is further configured to vary airspeed of the variable airflow 222 based on one or more detected air conditions. For instance, during the drying or dry cycle, controller 146 may receive one or more signals from air sensor 250, which correspond to a detected air condition (e.g., temperature value or humidity value).

Based on the detected air condition, the airspeed or speed of rotation of the tub fan 218 may increase or decrease. As an example, a chart, formula, or look-up table may be provided on controller 146 that correlates a detected air condition to a directed airspeed or rotation speed at tub fan 218. The correlation incorporated into the chart, formula, or look-up table may further consider additional variables, such as the water flow rate from water path 212, water temperature within water path 212, heat output from one or more heaters 260, 261, etc.

In certain embodiments, airspeed or rotation speed at tub fan 218 generally increases relative to the detected air temperature (e.g., linearly or, alternatively, non-linearly according to a predetermined relationship). Thus, a larger detected air temperature may generally prompt the controller 146 to direct the tub fan 218 to a larger directed airspeed or rotation speed. In additional or alternative embodiments, airspeed or rotation speed at tub fan 218 generally decreases relative to the detected humidity (e.g., linearly or, alternatively, non-linearly according to a predetermined relationship). Thus, a larger detected humidity may generally prompt the controller 146 to direct the tub fan 218 to a smaller directed airspeed or rotation speed.

In certain embodiments, fluid recirculation duct 220 defines a collection outlet 228 through which liquid (e.g., condensed water) may flow from water path 212. When assembled, collection outlet 228 may be downstream from path inlet 214 and upstream from path outlet 216. For instance, collection outlet 228 may be defined at a bottom end of fluid recirculation duct 220. As the water vapor within water path 212 condenses, the condensed water may collect (e.g., as motivated by gravity or tub fan 218) and flow from water path 212 through collection outlet 228 (e.g., to water path 212) without passing through path outlet 216.

Separate from air path 210, water path 212 may be defined, at least in part, by a cold water loop 230 (e.g., formed from one or more conduits or pipes through which liquid water may flow). As shown, cold water loop 230 generally defines water path 212 as a circular or looped path through which water may be recirculated and cooled. At least a portion of cold water loop 230 may be defined by fluid recirculation duct 220. Thus, a portion of water path 212 may expel water to a portion of air path 210. For instance, cold water loop 230 may extend from an area outside of fluid recirculation duct 220 and tub 104 to the interior of fluid recirculation duct 220, which defines air path 210. In turn, cold water loop 230 may extend to or through fluid recirculation duct 220 (e.g., a wall thereof). Within fluid recirculation duct 220, a cold water nozzle 234 defined by cold water loop 230 may be disposed. Thus, cold water nozzle 234 may be disposed in fluid communication between path inlet 214 and path outlet 216 to provide a condensing, cold-water flow 232 (e.g., at a relatively cold temperature from cold water source 264) into fluid recirculation duct 220 or air path 210.

Generally, cold water nozzle 234 defines one or more spray outlets from which a condensing, cold-water flow 232 may be directed (e.g., from cold water loop 230 to the air path 210). Any suitable shape or configuration of nozzle may be provided at cold water nozzle 234. During use, as the condensing, cold-water flow 232 sprays within air path 210, the water thereof may mix or entrain with the air from the wash chamber 106, including vaporized moisture in the air. As the condensing, cold-water flow 232 mixes with the air from wash chamber 106, the vaporized moisture within air path 210 may condense and separate upstream from collection outlet 228 or path outlet 216. In turn, a separate liquid water stream 236 (e.g., of the mixture of condensing, cold-water flow 232 and the condensed moisture from wash chamber 106) and a separated air stream 240 (e.g., of the remaining air from wash chamber 106) may be formed within fluid recirculation duct 220. In optional embodiments, cold water nozzle 234 is positioned above collection outlet 228 or path outlet 216. The liquid water stream 236 may thus flow downward (e.g., as motivated by gravity) before reaching collection outlet 228 or path outlet 216. In some embodiments, cold water loop 230 includes collection outlet 228. Thus, water may flow from the liquid water stream 236, through the collection outlet 228 and back to nozzle 234.

Generally, the water within cold water loop 230 may be seeded or refreshed from a suitable water source. For instance, a supply line 242 may connect to cold water loop 230 from a domestic water source (e.g., municipal water supply). Optionally, such a supply line 242 may terminate at a portion of water path 212 between the cold water nozzle 234 and collection outlet 228 (e.g., relative to the direction of cold-water flow 232). Additionally or alternatively, water within cold water loop 230 may be seeded or refreshed from water collected through collection outlet 228.

Separate from or in addition to any supply line 242, a drain line 262 may connect to cold water loop 230 to selectively permit the removal of water from cold water loop 230. For instance, drain line 262 may extend from a portion of cold water line 232 to a downstream drain outlet. For instance, a downstream drain outlet may extend to wash chamber 106 (e.g., below path outlet 216). Thus, water may flow from the water path 212 and drain line 262 to wash chamber 106 (e.g., at sump 152—FIG. 2). During use, such water may be subsequently expelled from wash chamber 106 (e.g., as part of a drain cycle). Alternatively, drain line 262 may extend to or terminate apart from tub 104, such as to a separate exhaust or drain conduit directly water outside of cabinet 102. During use, water within drain line 262 may be subsequently expelled from appliance 100 while bypassing chamber 106.

A loop pump 268 may be provided to selectively motivate water through or along water path 212. Specifically, loop pump 268 may be mounted along water path 212 to selectively start, continue, halt, or vary cold-water flow 232 to and from nozzle 234. For instance, loop pump 268 may be mounted between collection outlet 228 and nozzle 234 (e.g., relative to the direction of cold-water flow 232).

Generally, loop pump 268 may include or be provided as any suitable pump to force, displace, flow, or otherwise motivate water through water path 212. For instance, loop pump 268 may include a positive-displacement pump (e.g., gear pump, peristaltic pump, lobe pump, etc.) or rotodynamic pump (e.g., centrifugal or impeller pump, axial-flow pump, etc.). In some such embodiments, loop pump 268 includes or is provided as a variable-flow pump 268, that can selectively vary the flowrate of water (e.g., cold-water flow 232). In other words, loop pump 268 may selectively motivate a variable flowrate of the water within the cold water loop 230 or along water path 212, as would be understood in light of the present disclosure. For instance, a rotation speed of loop pump 268 may be varied to adjust (e.g., increase or decrease) the variable flowrate or flowrate of cold-water flow 232.

When assembled, loop pump 268 may be in operative (e.g., electrical or wireless) communication with controller 146. Loop pump 268 may be configured to rotate or activate at a plurality of discrete speeds (e.g., rotation speeds or predetermined water flowrates). Controller 146 may thus selectively direct loop pump 268 to motivate or otherwise vary the flowrate (e.g., volumetric flow rate) of cold-water flow 232 through water path 212—and thereby at stream 236. In some embodiments, loop pump 268 is further configured to vary volumetric flowrate of cold-water flow 232 based on one or more detected air or water conditions. For instance, during the drying or dry cycle, controller 146 may receive one or more signals from air sensor 250, which correspond to a detected air condition (e.g., temperature value or humidity value), or water sensor 252, which correspond to a detected water temperature along water path 212.

Based on the detected air condition or water temperature, the volumetric flowrate of cold-water flow 232 through water path 212 and to air path 210 may increase or decrease. As an example, a chart, formula, or look-up table may be provided on controller 146 that correlates a detected air condition to a directed volumetric flowrate or rotation speed at loop pump 268. In certain embodiments, volumetric flowrate or rotation speed at loop pump 268 generally increases relative to the detected air temperature (e.g., linearly or, alternatively, non-linearly according to a predetermined relationship). Thus, a larger detected air temperature may generally prompt the controller 146 to direct the loop pump 268 to a larger directed volumetric flowrate or rotation speed. In additional or alternative embodiments, volumetric flowrate or rotation speed at loop pump 268 generally decreases relative to the detected humidity (e.g., linearly or, alternatively, non-linearly according to a predetermined relationship). Thus, a larger detected humidity may generally prompt the controller 146 to direct the loop pump 268 to a smaller directed volumetric flowrate or rotation speed. In further additional or alternative embodiments, volumetric flowrate or rotation speed at loop pump 268 generally increases relative to the detected water temperature (e.g., linearly or, alternatively, non-linearly according to a predetermined relationship). Thus, a larger detected water temperature may generally prompt the controller 146 to direct the loop pump 268 to a larger directed volumetric flowrate or rotation speed.

In exemplary embodiments, a heat exchanger 270 is mounted to cold water loop 230 to draw heat from or otherwise cool water within cold water loop 230. Specifically, heat exchanger 270 may be mounted outside or apart from fluid recirculation duct 220. For instance, heat exchanger 270 may be disposed within cabinet in fluid communication between collection outlet 228 and nozzle 234 (i.e., between collection outlet 228 and nozzle 234 relative to the direction of cold-water flow 232). In turn, water may be cooled prior to being sprayed from the nozzle 234. In some such embodiments, heat exchanger 270 is further disposed in fluid communication between loop pump 268 and nozzle 234. Thus, heat exchanger 270 may be characterized as being downstream from loop pump 268 while being upstream from nozzle 234. Generally, heat exchanger 270 may be provided as any suitable heat-conducting structure. For instance, heat exchanger 270 may include or be provided as a passive heat sink. In some such embodiments, a plurality of metal fins 272 extend from a portion (e.g., bent, serpentine, or multi-pass portion) of cold water loop 230. Thus, heat may be conducted from water along water path 212, through the walls of cold water loop 230, and to the ambient environment through the plurality of metal fins 272.

In optional embodiments, a loop fan 274 or blower may be provided to motivate air across heat exchanger 270. Specifically, loop fan 274 may be directed at heat exchanger 270 (e.g., within cabinet) outside of cold water loop 230 or air path 212 (e.g., in fluid isolation from tub fan 218). Thus, loop fan 274 may be located adjacent to heat exchanger 270 or otherwise proximal to a common portion of cold water loop 230. Generally, loop fan 274 may include or be provided as any suitable air handler, such as an axial fan, tangential fan, etc. When assembled, loop fan 274 may be in operative (e.g., electrical or wireless) communication with controller 146. Controller 146 may thus selectively direct loop fan 274 to rotate or otherwise motivate air through air path 210. In some embodiments, loop fan 274 is provided as a variable-speed fan and is thus configured to vary the speed of its rotation (i.e., the rotation of a blade or impeller of loop fan 274). For instance, loop fan 274 may be configured to rotate at a plurality of discrete speeds. As would be understood, varying the speed of rotation of loop fan 274 may in turn vary the airspeed (e.g., the volumetric flow rate of air) of a variable exchange airflow 276 across heat exchanger 270. In some such embodiments, loop fan 274 is further configured to vary airspeed of the variable exchange airflow 276 based on one or more detected air conditions. For instance, during the drying or dry cycle, controller 146 may receive one or more signals from water sensor 252, which correspond to a detected water temperature along water path 212.

Based on the detected water temperature, the airspeed or speed of rotation of the loop fan 274 may increase or decrease. As an example, a chart, formula, or look-up table may be provided on controller 146 that correlates a water temperature to a directed volumetric or flowrate rotation speed at loop fan 274. In certain embodiments, volumetric flowrate or rotation speed at loop fan 274 generally increases relative to the detected water temperature (e.g., linearly or, alternatively, non-linearly according to a predetermined relationship). Thus, a larger detected water temperature may generally prompt the controller 146 to direct the loop fan 274 to a larger directed airspeed or rotation speed.

As noted above, water sensor 252 may be mounted along cold water loop 230. Generally, water sensor 252 may be disposed at any suitable location to detect water temperature along water path 212. As an example, water sensor 252 may be mounted on or within fluid recirculation duct 220 (e.g., below or apart from nozzle 234. As an additional or alternative example, water sensor 252 may be disposed in fluid communication between nozzle 234 and heat exchanger 270 (i.e., between nozzle 234 and heat exchanger 270 relative to the direction of cold-water flow 232). For instance, water sensor 252 may be mounted between collection outlet 228 and heat exchanger 270. Thus, a temperature of water along water path 212 may be detected or measured prior to cooling.

In optional embodiments, a heater 261 (e.g., heating element) is mounted along fluid recirculation duct 220 to selectively direct heat to air within air path 210. As shown, heater 261 may be mounted along fluid recirculation duct 220 downstream from cold water nozzle 234 or collection outlet 228. Air returned to wash chamber 106 may thus be provided at an elevated temperature, advantageously increasing the drying efficacy and moisture capacity of the air within wash chamber 106. Optionally, heater 261 may be horizontally spaced apart from cold water nozzle 234 or collection outlet 228. Condensed water (e.g., within the liquid water stream 236) may thus separate from the dry air prior to the dry air reaching heater 261 along air path 210. Generally, heater 261 may include any suitable heating element to be selectively activated (e.g., as directed by controller 146). For instance, heater 261 may include a resistive heating element, halogen heating element, radiant heating element, etc.

As would be understood in light of the present disclosure, controller 146 may be configured to initiate or direct a dry cycle (e.g., following a drain or wash cycle). Such a drain cycle may include directing one or more heaters 260, 261 to an active state (e.g., according to a predetermined heat output or duty cycle), and thereby heat air within the wash chamber 106. While the heater is active, the controller 146 may further direct fan to rotate and, thus, motivate air through air path 210. Moreover, loop pump 268 may be directed to permit a cold-water flow 232 to nozzle 234 (e.g., and thus to air path 210 as a stream 236) while heater and fan are active. During the dry cycle, the controller 146 may repeatedly receive air condition signals from air sensor 250, as described above. As also described above, the flow of air or water within air path 210 may be varied based on such signals. For instance, controller 146 may direct tub fan 218 to vary the airspeed based on the received air condition signals (e.g., repeatedly over the course of the dry cycle). Additionally or alternatively, controller 146 may direct variable loop pump 268 to vary the volumetric flow rate of water to air path 210 based on the received air condition signals (e.g., repeatedly over the course of the dry cycle). Advantageously, such dry cycles may quickly and efficiently prompt vaporized moisture within air path 210 (e.g., from wash chamber 106) to condense and separate from air before such air is returned to wash chamber 106, thereby improving drying times for the dishwasher appliance 100.

Figure 5:
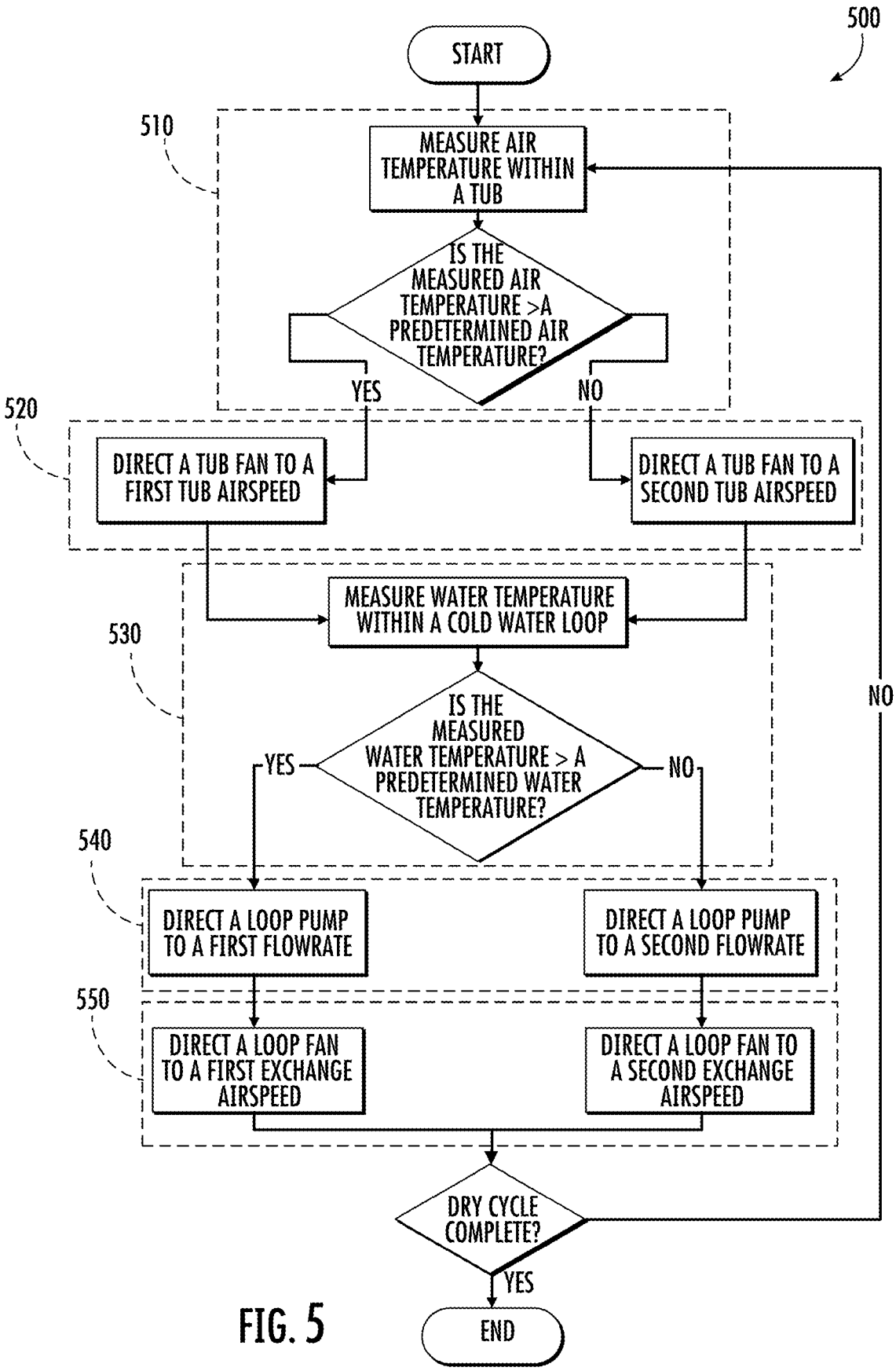
FIG. 5 provides a flow chart illustrating a method of operating a dishwashing appliance according to exemplary embodiments of the present disclosure.

Turning now to FIG. 5, flow chart is provided of a method 500 according to exemplary embodiments of the present disclosure. Generally, the method 500 provides a method of operating a dishwashing appliance (e.g., dishwashing appliance 100—FIG. 1). The method 500 can be performed, for instance, by the controller 146 (FIG. 1).

FIG. 5 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure (except as otherwise described).

At 510, the method 500 includes evaluating air temperature in the tub (e.g., during or as part of a dry cycle wherein one or more heaters 260, 261—FIG. 3—are activated, as would be understood in light of the present disclosure). For instance, air temperature may be measured (e.g., at air sensor 250—FIG. 3). The measured air temperature may then be compared, for instance, to one or more predetermined air temperatures (e.g., thresholds). Subsequently, the method 500 may proceed to 520.

At 520, the method 500 includes directing the tub fan based on the air temperature. Specifically, the tub fan (e.g., fan 218) may be directed between two or more predetermined airspeeds or rotation speeds according to whether a predetermined air temperature threshold is exceeded. In the illustrated embodiments, for instance, the tub fan is directed to a first tub airspeed in response to the measured air temperature being greater than the predetermined air temperature. By contrast, the tub fan is directed to a second tub airspeed, which may be less than the first tub airspeed, in response to the measured air temperature being less than or equal to the predetermined air temperature.

At 530, the method 500 includes evaluating water temperature in the cold water loop. For instance, water temperature may be measured (e.g., at water sensor 252—FIG. 3). The measured water temperature may then be compared, for instance, to one or more predetermined water temperatures (e.g., thresholds). Subsequently, the method 500 may proceed to 540 or 550.

At 540, the method 500 includes directing the loop pump based on the measured water temperature. Specifically, the loop pump (e.g., loop pump 268—FIG. 3) may be directed between two or more predetermined flowrates or rotation speeds according to whether a predetermined water temperature threshold is exceeded. In the illustrated embodiments, for instance, the loop pump is directed to a first flowrate in response to the measured water temperature being greater than the predetermined water temperature. By contrast, the loop pump is directed to a second flowrate, which may be less than the first flowrate, in response to the measured water temperature being less than or equal to the predetermined water temperature.

At 550, the method 500 includes directing the loop fan based on the measured water temperature (e.g., separately from or in addition to 540). Specifically, the loop fan (e.g., loop fan 274—FIG. 3) may be directed between two or more predetermined exchange airspeeds or rotation speeds according to whether a predetermined water temperature threshold is exceeded. In the illustrated embodiments, for instance, the loop fan is directed to a first exchange airspeed in response to the measured water temperature being greater than the predetermined air temperature. By contrast, the loop fan is directed to a second exchange airspeed, which may be less than the first exchange airspeed, in response to the measured water temperature being less than or equal to the predetermined water temperature.

Following 540 or 550, the method 500 may evaluate the status of the corresponding dry cycle. In other words, it may be determined if the dry cycle is complete (e.g., based on set time or variable, as would be understood). If the cycle is not complete, the method may return to 510. Thus, the operation of various elements (e.g., tub fan, loop pump, and loop fan) may be constantly updated according to contemporary or current conditions within the appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance comprising:

a cabinet;

a tub housed within the cabinet and defining a wash chamber;

a pump configured to deliver a wash fluid to the wash chamber;

a spray assembly housed within the wash chamber of the tub in fluid communication with the pump to receive wash fluid therefrom;

a fluid recirculation duct extending from a path inlet to a path outlet to recirculate air within the wash chamber, the path inlet defined in fluid communication between the wash chamber and the path outlet, and the path outlet defined in fluid communication between the path inlet and the wash chamber downstream from the path inlet;

a cold water loop defining a cold water nozzle disposed within the fluid recirculation duct to provide a condensing, cold-water flow into the fluid recirculation duct between the path inlet and the path outlet;

a loop pump mounted along the cold water loop to motivate the water within the cold water loop;

a heat exchanger mounted to the cold water loop outside of the fluid recirculation duct to cool water within the cold water loop;

a loop fan directed at the heat exchanger outside of the cold water loop to motivate an exchange airflow across the heat exchanger;

a variable-speed tub fan configured to rotate at a plurality of discrete speeds, the variable-speed tub fan being in fluid communication with the fluid recirculation duct to selectively motivate a variable airflow from the path inlet to the path outlet; and a temperature sensor mounted along the cold water loop to detect a water temperature therein, wherein the loop pump is a variable-speed loop pump configured to selectively motivate a variable flowrate of the water within the cold water loop based on the detected water temperature.

2. The dishwashing appliance of claim 1, further comprising a temperature sensor mounted along the cold water loop to detect a water temperature therein, wherein the loop fan is a variable-speed loop fan configured to selectively vary airspeed of the exchange airflow based on the detected water temperature.

3. The dishwashing appliance of claim 1, wherein the variable-speed tub fan is mounted downstream from the path inlet in upstream fluid communication with the wash chamber.

4. A dishwashing appliance comprising:

a cabinet;

a tub housed within the cabinet and defining a wash chamber;

a pump configured to deliver a wash fluid to the wash chamber;

a spray assembly housed within the wash chamber of the tub in fluid communication with the pump to receive wash fluid therefrom;

a fluid recirculation duct extending from a path inlet to a path outlet to recirculate air within the wash chamber, the path inlet defined in fluid communication between the wash chamber and the path outlet, and the path outlet defined in fluid communication between the path inlet and the wash chamber downstream from the path inlet;

a cold water loop defining a cold water nozzle disposed within the fluid recirculation duct to provide a condensing, cold-water flow into the fluid recirculation duct between the path inlet and the path outlet;

a heat exchanger mounted to the cold water loop outside of the fluid recirculation duct to cool water within the cold water loop;

a tub fan in fluid communication with the fluid recirculation duct to selectively motivate an airflow from the path inlet to the path outlet;

a temperature sensor mounted along the cold water loop to detect a water temperature therein; and a loop pump mounted along the cold water loop to motivate the water within the cold water loop, the loop pump being a variable-speed loop pump configured to selectively motivate a variable flowrate of the water within the cold water loop based on the detected water temperature.

5. The dishwashing appliance of claim 4, further comprising an air sensor mounted within the wash chamber to detect an air condition therein, wherein the tub fan is a variable-speed tub fan configured to vary airspeed of the airflow based on the detected air condition.

6. The dishwashing appliance of claim 5, wherein the air sensor comprises an air temperature sensor, and wherein the detected air condition is a detected air temperature value within the wash chamber.

7. The dishwashing appliance of claim 5, wherein the air sensor comprises a humidity sensor, and wherein the detected air condition is a detected air humidity value within the wash chamber.

8. The dishwashing appliance of claim 4, further comprising a loop fan directed at the heat exchanger outside of the cold water loop to motivate an exchange airflow across the heat exchanger.

9. The dishwashing appliance of claim 8, wherein the loop fan is a variable-speed loop fan configured to selectively vary airspeed of the exchange airflow based on the detected water temperature.

10. The dishwashing appliance of claim 4, wherein the tub fan is mounted downstream from the path inlet in upstream fluid communication with the wash chamber.

11. A dishwashing appliance comprising:

a cabinet;

a tub housed within the cabinet and defining a wash chamber;

a pump configured to deliver a wash fluid to the wash chamber;

a spray assembly housed within the wash chamber of the tub in fluid communication with the pump to receive wash fluid therefrom;

a fluid recirculation duct extending from a path inlet to a path outlet to recirculate air within the wash chamber, the path inlet defined in fluid communication between the wash chamber and the path outlet, and the path outlet defined in fluid communication between the path inlet and the wash chamber downstream from the path inlet;

a cold water loop defining a cold water nozzle disposed within the fluid recirculation duct to provide a condensing, cold-water flow into the fluid recirculation duct between the path inlet and the path outlet;

a heat exchanger mounted to the cold water loop outside of the fluid recirculation duct to cool water within the cold water loop;

a tub fan in fluid communication with the fluid recirculation duct to selectively motivate an airflow from the path inlet to the path outlet;

a temperature sensor mounted along the cold water loop to detect a water temperature therein; and a loop fan directed at the heat exchanger outside of the cold water loop to motivate an exchange airflow across the heat exchanger, the loop fan being a variable-speed loop fan configured to selectively vary airspeed of the exchange airflow based on the detected water temperature.

12. The dishwashing appliance of claim 11, further comprising an air sensor mounted within the wash chamber to detect an air condition therein, wherein the tub fan is a variable-speed tub fan configured to vary airspeed of the airflow based on the detected air condition.

13. The dishwashing appliance of claim 12, wherein the air sensor comprises an air temperature sensor, and wherein the detected air condition is a detected air temperature value within the wash chamber.

14. The dishwashing appliance of claim 12, wherein the air sensor comprises a humidity sensor, and wherein the detected air condition is a detected air humidity value within the wash chamber.

15. The dishwashing appliance of claim 11, wherein the tub fan is mounted downstream from the path inlet in upstream fluid communication with the wash chamber.

* * * * *